US006621196B1

(12) United States Patent
Geissinger et al.

(10) Patent No.: US 6,621,196 B1
(45) Date of Patent: Sep. 16, 2003

(54) CERAMIC SHEATHED ELEMENT GLOW PLUG

(75) Inventors: Albrecht Geissinger, Muehlacker (DE); Gert Lindemann, Lichtenstein (DE); Christoph Haluschka, Klingenberg (DE); Thomas Nething, Leonberg (DE); Wolfgang Dressler, Vaihingen/Enz (DE); Friederike Lindner, Gerlingen (DE); Horst Boeder, Sindelfingen (DE); Matthias Rowek, Goeppingen (DE); Wolfgang Otterbach, Stuttgart (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/806,272

(22) PCT Filed: Sep. 25, 1999

(86) PCT No.: PCT/DE99/03098

§ 371 (c)(1),
(2), (4) Date: Nov. 20, 2001

(87) PCT Pub. No.: WO00/19772

PCT Pub. Date: Apr. 6, 2000

(30) Foreign Application Priority Data

Sep. 28, 1998 (DE) ..... 198 44 347

(51) Int. Cl.[7] ..... F02M 57/06; F02P 13/00; H01T 13/00

(52) U.S. Cl. ..... 313/118; 313/137; 313/143; 313/144

(58) Field of Search ..... 313/118, 138, 313/141, 143, 144, 137

(56) References Cited

U.S. PATENT DOCUMENTS

| | | | | |
|---|---|---|---|---|
| 4,418,661 A | * | 12/1983 | Esper et al. | 123/145 A |
| 4,661,686 A | | 4/1987 | Yokoi et al. | 219/270 |
| 4,931,619 A | * | 6/1990 | Ogata et al. | 219/270 |
| 5,304,778 A | * | 4/1994 | Dasgupta et al. | 219/270 |
| 6,437,492 B1 | * | 8/2002 | Geissinger et al. | 313/118 |

FOREIGN PATENT DOCUMENTS

| | | |
|---|---|---|
| DE | 41 33 046 | 4/1992 |
| EP | 0 040 997 | 12/1981 |

* cited by examiner

*Primary Examiner*—Vip Patel
*Assistant Examiner*—Kevin Quarterman
(74) *Attorney, Agent, or Firm*—Kenyon & Kenyon

(57) ABSTRACT

A ceramic sheathed-element glow plug is proposed in which a metallic tubular holder holds a ceramic U-shaped heating device in a cantilevered fashion at its combustion chamber side end and has a terminal stud for applying a voltage to the ceramic heating device on the end remote from the combustion chamber. At its end enclosed by the holder, the ceramic heating device has a segment of greatest diameter and is coated with an insulating layer which has recesses for an electrical contacting. One recess is provided at the end of the ceramic heating device remote from the combustion chamber and a second recess is provided on the external wall of the ceramic heating device. A for an electrically conductive sealing compound is provided between the external wall of the ceramic heating device and the internal wall of the holder.

7 Claims, 2 Drawing Sheets

CERAMIC SHEATHED ELEMENT GLOW PLUG

FIELD OF THE INVENTION

The present invention relates to a ceramic sheathed-element glow plug for diesel engines.

BACKGROUND INFORMATION

A glow plug is described in German Published Patent Application No. 38 37 128 in which a ceramic heating device is held by the tip of a cylindrical holder. The ceramic heating device is electrically insulated with respect to the holder. Provided on the end of the cylindrical holder which is opposite to the ceramic heating device is a connector device which makes contact to the supply voltage. The ceramic heating device has a U-shaped heating segment, the two ends of the U-shaped heating segments each making contact with the connector device. During a preheat operation, a voltage is applied to the ceramic heating device so that a current flows from one end of the U-shaped heating segment via the tip of the heating segment on the combustion chamber side to the other end of the U-shaped heating segment. Due to the resistance of the ceramic, the current heats the heating segment so that the latter glows and the fuel/air mixture is heated for ignition.

SUMMARY OF THE INVENTION

The ceramic sheathed-element glow plug according to the present invention, having the features of the main claim, has the advantage that a very simple contacting of the ceramic heating element is possible without additional terminal contacts being sintered in. In addition, the contacting of the glow plug-shaped ceramic heating device without an adhering connection due to the simple design of contact surfaces in the insulation has the advantage that a sintered in metallic lead can be omitted. This ensures that the ceramic is not weakened by sintered-in foreign bodies, nor is the ceramic or the contact damaged during assembly. Finally, the production is simpler and accordingly more cost-effective. At the same time, the introduction of a packing between the internal housing wall and the external wall of the ceramic heating device brings about a very good seal in relation to the combustion chamber with simultaneously improved contacting.

It is particularly advantageous that the glow plug has a segment of greater diameter in the area remote from the combustion chamber, since the shoulder thus produced between the segment with smaller diameter and the segment with greater diameter compresses the gasket material when the glow plug is inserted into the housing and thus ensures a very good seal. The seal of the components of the sheathed-element glow plug that are remote from the combustion chamber against the combustion chamber is considerably improved. Finally, the surface pressures for attaining a reliable contact with ground and engine compartment sealing are minimized, which in turn reduces the tangential tensile stresses in the ceramic sheathed-element glow plug. Furthermore, the use of a contact spring for the connection of the face of the first end of the U-shaped heating device, which is remote from the combustion chamber, in order to make contact with the supply voltage makes it possible to compensate for varying layer thicknesses between the insulating layer and the recesses in this insulating layer. This also ensures that a reliable contact is made. Since the pressure forces for achieving a reliable contact are low in the glow plug according to the present invention, no additional tensile stresses are produced in the ceramic glow plug. The use of a powder seal as the sealing compound between the housing and the glow plug ensures that no special requirements are placed on the surface quality of the seal. As a result, no excess stresses can arise due to surface roughness.

DETAILED DESCRIPTION

Figure 1:
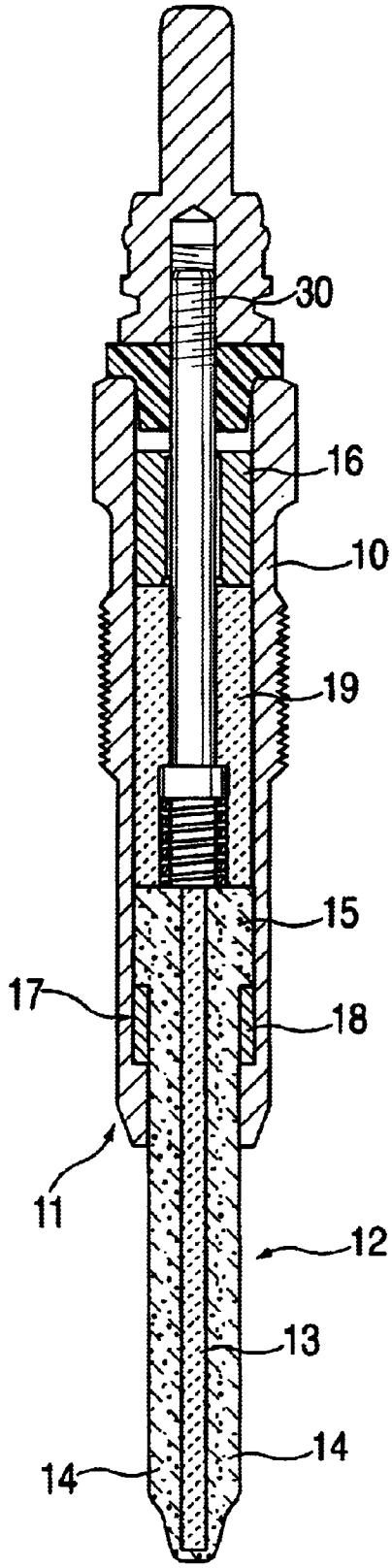
FIG. 1 shows the sheathed-element glow plug of the present invention.

FIG. 1 shows a longitudinal section through a ceramic sheathed-element glow plug according to the present invention. The sheathed-element glow plug has a cylindrical tubular metal housing which constitutes glow plug housing 10. At its combustion chamber end 11, glow plug housing 10 encloses a ceramic heating device 12. This ceramic heating device 12 is a glow plug designed as a ceramic stratified composite which includes an insulating ceramic composite layer 13 between two electrically conductive ceramic composite layers 14. The electrically conductive ceramic composite layers are essentially arranged in a U-shape. At the tip of the ceramic heating device, the two electrically conductive ceramic composite layers 14 are connected by a thin web of electrically conductive ceramic composite. The insulation and electrical contacting of the glow plug will be explained further below with reference to FIG. 2. As the result of a strong reduction of the electrically conductive cross-section and/or of the use of a ceramic with a higher specific electrical resistance, the electrical resistance in the area of the glow tip is higher than in the two legs of the U-shaped electrically conductive ceramic composite layers. When a voltage is applied, the heating current flows from the end of the first leg of the U-shaped ceramic heating device via the tip on the combustion chamber side into the other leg of the U-shaped ceramic heating device, where the contact with ground is then made via an electrical connection to the glow plug housing. The tip of the ceramic heating device on the combustion chamber side glows first due to the fact that the resistance is designed to be greatest there. Suitable fillers cause the electrically conductive ceramic to have a positive temperature coefficient of electrical resistance so that the electrical resistance increases as the temperature rises, which in turn causes the glow plug temperature to be self-regulating. The heating rate and the steady-state temperature of the glow plug can be adjusted essentially by the resistance ratio of the tip and supply lead, the tip geometry, the specific electrical resistance of the ceramic and the temperature coefficients of the ceramic.

The back segment of ceramic heating device 12, also referred to as glow plug, which is enclosed by cylindrical glow plug housing 10 has an area of greater diameter 15. The diameter of this back segment of the glow plug is selected in such a way that the glow plug is displaceable during the assembly of the sheathed-element glow plug. The glow plug, i.e., ceramic heating device 12, is mounted in cylindrical glow plug housing 10 in such a way that a hollow space 17 is formed in the area of smaller diameter between the internal wall of tubular metal housing 11 and the external wall of ceramic heating device 12, the hollow space being filled with an electrically conductive, compressible material 18. The electrically conductive material 18 may be, for example, graphite, a metal powder, a powder mixture of ceramic and conductive particles or a hollow cylinder wound from a graphite film.

When the sheathed-element glow plug is assembled, electrically conductive material 18 is first introduced as a preform from the opening of glow plug housing 10 remote from the combustion chamber into glow plug housing 10 and subsequently the glow plug is inserted. Remote from the combustion chamber, ceramic heating device 12 is followed by a ceramic sleeve 19 and then by a metal ring 16. By application of force on these joined parts, the glow plug is pressed into glow plug housing 10 in such a way that electrically conductive material 18 is compressed. During the compression process, the volume of hollow space 17 is reduced.

Figure 2:
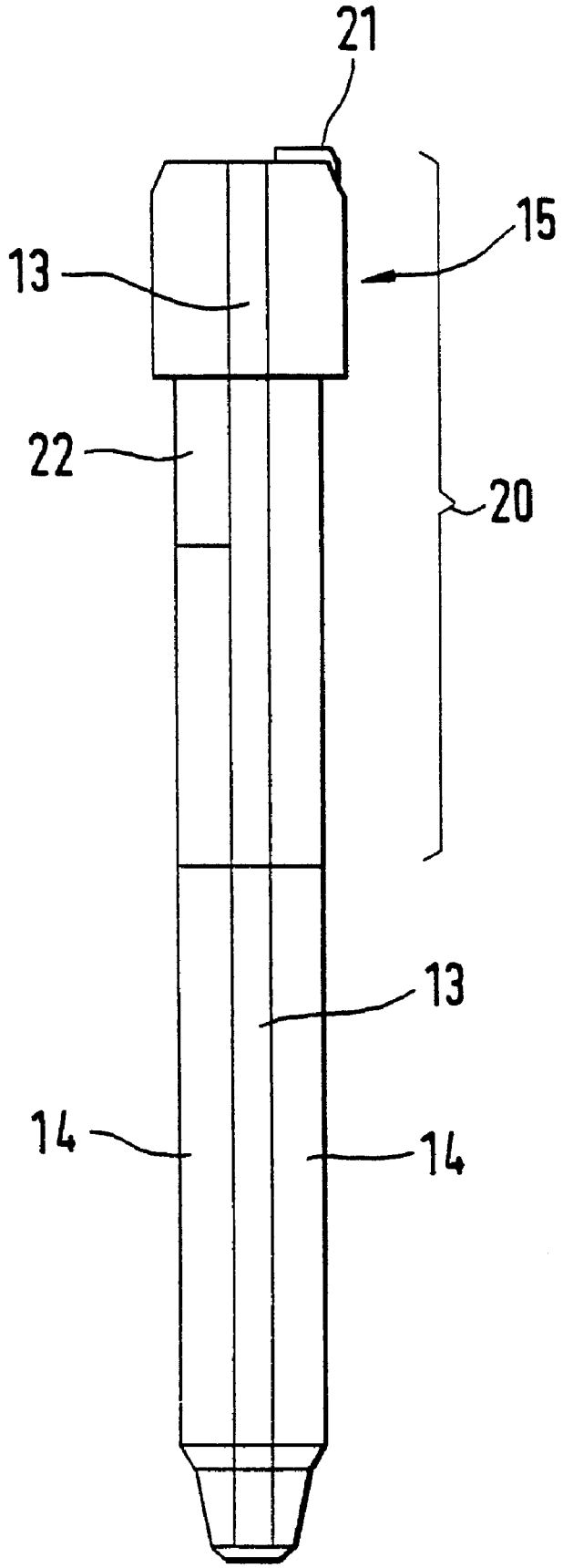
FIG. 2 shows the ceramic glow plug.

FIG. 2 shows ceramic heating device 12 separately. In this depiction it can be seen clearly that the glow plug has a first diameter over its length extending continuously to the end segment remote from the combustion chamber and has a segment 15 of greater diameter at the end remote from the combustion chamber. At least in the area in which it is enclosed by glow plug housing 10, the glow plug is coated with an insulating layer 20, this insulating layer being produced by vitrification. The area in which this insulating layer 20 is applied is shaded in FIG. 2. For the electrical contacting, recesses 21 and 22 are made in the insulating layer. A first recess 21 is located on the end of the glow plug remote from the combustion chamber and in such a way that a contacting of the terminal stud 30 (see FIG. 1) is made with one leg of the U-shaped electrically conductive ceramic. The second electrical contact is made on the lateral external wall of the second leg of the U-shaped, electrically conductive ceramic. The contact of this second recess 22 with the glow plug housing is made via sealing compound 17, as can be seen in FIG. 1. In FIG. 2, recesses 21 and 22 are each identified by a dark area. As a result, it can be readily recognized in FIG. 2 that the contact surfaces are selected in such a way that when a voltage is applied, the heating current flows from one end of the U-shaped heating device via the tip in the combustion chamber to the other end of the U-shaped heating device. For good contacting, recesses 21 and 22 can each be provided with a metal coating, for example, nickel.

What is claimed is:

1. A ceramic sheathed-element glow plug, comprising:

a U-shaped ceramic heating device in the form of a glow plug;

a tubular metal housing including a combustion chamber side end that holds the U-shaped ceramic heating device in a cantilevered fashion; and a terminal stud arranged on an end remote from a combustion chamber, the terminal stud being in an electrical contact with the U-shaped ceramic heating device, wherein:

the U-shaped ceramic heating device is coated with an insulating layer, at least in an area in which the U-shaped ceramic heating device is enclosed by the tubular metal housing, recesses are provided in the insulating layer, a first recess is arranged on a face of an end of the U-shaped ceramic heating device that is remote from the combustion chamber, a second recess is arranged laterally on an external wall of another end of the U-shaped ceramic heating device, and an electrically conductive sealing compound is arranged in an area of the second recess between the external wall of the U-shaped ceramic heating device and an internal wall of the tubular metal housing.

2. The ceramic sheathed-element glow plug according to claim 1, wherein:

the U-shaped ceramic heating device has a first diameter over its length extending continuously to the end segment remote from the combustion chamber and has a second diameter, larger than the first diameter, at the end remote from the combustion chamber, and the second diameter is selected such that the U-shaped ceramic heating device can be pushed into the tubular metal housing during an assembly from the end remote from the combustion chamber.

3. The ceramic sheathed-element glow plug according to claim 1, wherein:

the insulating layer is applied by vitrification.

4. The ceramic sheathed-element glow plug according to claim 1, wherein:

the recesses are metallized in the insulating layer.

5. The ceramic sheathed-element glow plug according to claim 1, wherein:

the electrically conductive sealing compound includes an electrically conductive powder.

6. The ceramic sheathed-element glow plug according to claim 5, wherein:

the electrically conductive powder includes one of graphite, a metal powder, and a powder mixture of ceramic with conductive particles.

7. The ceramic sheathed-element glow plug according to claim 1, wherein:

the electrically conductive sealing compound includes a hollow cylinder wound from a graphite film.

* * * * *

UNITED STATES PATENT AND TRADEMARK OFFICE

CERTIFICATE OF CORRECTION

PATENT NO. : 6,621,196 B1
DATED : September 16, 2003
INVENTOR(S) : Albrecht Geissinger et al.

It is certified that error appears in the above-identified patent and that said Letters Patent is hereby corrected as shown below:

Title page,
Item [57], ABSTRACT,
Line 12, change "A for an electrically" to -- A hollow space for an electrically --.

Signed and Sealed this

Eighteenth Day of May, 2004

JON W. DUDAS
*Acting Director of the United States Patent and Trademark Office*